US005215829A

United States Patent [19]

Matsunobu et al.

[11] Patent Number: 5,215,829

[45] Date of Patent: Jun. 1, 1993

[54] METHOD FOR STRENGTHENING PRESSURE RESISTANCE OF A HOLLOWED METALLIC STRUCTURE AND A PRESSURE RESISTANT STRUCTURE MADE THEREBY

[75] Inventors: Takashi Matsunobu; Kenzi Aizawa; Kazumi Anazawa, all of Hitachi; Kunio Enomoto, Tokai, all of Japan

[73] Assignee: Hitachi, Ltd., Tokyo, Japan

[21] Appl. No.: 645,489

[22] Filed: Jan. 24, 1991

[30] Foreign Application Priority Data

Jan. 24, 1990 [JP] Japan ..... 2-12598

[51] Int. Cl.[5] ..... C21D 9/14

[52] U.S. Cl. ..... 428/586; 148/570; 148/571; 148/590; 148/714; 148/909

[58] Field of Search ..... 148/570, 571, 590, 714, 148/909; 428/586, 599

[56] References Cited

U.S. PATENT DOCUMENTS

| | | | |
|---|---|---|---|
| 2,604,419 | 7/1952 | Herbenar | 148/571 |
| 2,888,374 | 5/1959 | Heinenberg | 148/590 |
| 3,992,231 | 11/1976 | Timmons | 148/909 |
| 4,001,054 | 1/1977 | Makepeace | 148/909 |
| 4,110,092 | 8/1978 | Kunioka et al. | 148/714 |
| 4,229,235 | 10/1980 | Matsuda et al. | 148/909 |
| 4,836,866 | 6/1989 | Thuse | 148/570 |
| 4,842,655 | 6/1989 | Porowski et al. | 148/714 |

FOREIGN PATENT DOCUMENTS

| | | | |
|---|---|---|---|
| 55-34667 | 3/1980 | Japan | 148/590 |
| 56-136926 | 10/1981 | Japan | 148/570 |
| 59-107017 | 6/1984 | Japan | 148/570 |
| 60-174824 | 9/1985 | Japan | 148/570 |
| 61-30626 | 2/1986 | Japan | 148/570 |
| 62-199722 | 9/1987 | Japan | 148/570 |
| 831815 | 5/1981 | U.S.S.R. | 148/570 |
| 894002 | 12/1981 | U.S.S.R. | 148/570 |

*Primary Examiner*—John Zimmerman

*Attorney, Agent, or Firm*—Antonelli, Terry, Stout & Kraus

[57] ABSTRACT

A method for strengthening a pressure resistant property of a hollowed structure made of a metallic material and a pressure resistant hollowed structure made by such method. The method includes providing a temperature differential in a thickness direction between an outer side and an inner side of the metallic material with an arranged sufficient to generate a stress not exceeding a yielding stress of the metallic material. The outer side and inner side are pressurized so as to superimposed a stress generated by the pressurizing and the stress caused by the temperature differential reaching the yielding stress of the metallic material. The pressure is released subsequent to the superimposed stress reaching a level of the yielding stress of the metallic material. The compressive residual stress has a larger absolute value than a tensile stress caused in the inner side of the hollowed structure by the internal pressure, with the tensile residual stress in an outer side of the hollowed structure having a value of less than the tensile yielding stress of the metallic material even though the tensile stress is superimposed in the outer side of the hollowed structure by the internal pressure.

7 Claims, 12 Drawing Sheets

TEMPERATURE AT OUTER SURFACE OF PIPE (°C)
700
600
500
400
300
200
0
0
0.3
0.4
0.5
0.6
0.7
0.8
MOVING SPEED OF HIGH FREQUENCY OSCILLATION COIL (mm/s)
20
21
22

METHOD FOR STRENGTHENING PRESSURE RESISTANCE OF A HOLLOWED METALLIC STRUCTURE AND A PRESSURE RESISTANT STRUCTURE MADE THEREBY

BACKGROUND OF THE INVENTION

The present invention relates to a method and apparatus for strengthening pressure resistance of a hollow metallic structure such as, for example, a pipe conveying high pressure fluid.

In, for example, JP-B53-38246 (1987), a thermal treatment is applied to a metallic pipe in a plant which deals with high pressure fluid in order to increase reliability in the transportation of high pressure fluid by the steel pipe.

In the above-referenced thermal treatment arrangement, an apparatus is proposed wherein valves partition a interior of a portion of a steel pipe to be thermally treated in a liquid tight manner, and a heating coil of a high frequency induction heater is provided around the portion of the steel pipe, or an electrode is connected to a power source and is attached to the steel pipe so as to improve a resistance to stress corrosion cracking.

In the last-mentioned apparatus, a coolant, enclosed in the partitioned portion of the steel pipe by valves, becomes stagnant in the portion of the steel pipe being treated. By virtue of the existence of the coolant in the steel pipe, an outer side of the portion of the steel pipe being treated is heated with the heater, while an inner side is cooled with the coolant which removes the heat from the inner surface. The heating is continued until a temperature differential between the outer side and the inner side of the steel pipe reaches a temperature differential which causes a tensile yielding stress in the inner side of the steel pipe and a compressive yielding stress in the outer side of the steel pipe. The heating is subsequently stopped and a part of the strain is released following a stress-strain curve which is different from a stress-strain curve of a steel pipe obtained during the heating because the steel pipe reached a yielding region once before in the thermal treatment, and as a result, a balanced condition is achieved wherein a compressive residual stress is provided in the inner side of the steel pipe and a tensile residual stress is provided in the outer side of the steel pipe, and absolute values of the compressive residual stress and the tensile residual stresses are nearly equal.

By providing the compressive residual stress in the inner side of the steel pipe by the method described above, a pressure resistance property of the steel pipe is strengthened with an offset of a tensile stress in the inner side of the steel pipe which is caused by an internal pressure of a fluid in plant operation with the provided compressive residual stress in the inner side of the steel pipe.

Another example of the prior art to strengthen a pressure resistance property of a steel pipe by providing a compressive residual stress in an inner side of the steel pipe is disclosed in the JP-A-57-177924 (1982), wherein a volume of ice is used over a given time period to form ice plugs by freezing the coolant in side regions adjacent to both sides of a portion of the steel pipe being treated for raising a internal pressure in the pipe to cause a stress higher than a yielding stress of the steel pipe and causing a yielding of the steel pipe which provides a compressive residual stress in the inner side of the pipe after releasing of the internal pressure with thawing of ice by heating.

In the JP-B-53-38246 proposal, a strength of the tensile residual stress which is provided in the outer side of the steel pipe is as large as being equal to a strength of the compressive residual stress in the inner side of the steel pipe, and when an internal high pressure is applied in the steel pipe, a stress caused by the internal high pressure to the steel pipe is tensile stress in all regions through the wall of the steel pipe in a thickness direction from the inner side to the outer side of the steel pipe. Therefore, when a large tensile residual stress is provided in the outer side of the steel pipe, an effect of a tensile stress in the outer side of the steel pipe, larger than a yielding stress of a material of the steel pipe, results because of a superimposition of an additive tensile stress caused by high internal pressure loading in plant operation on the tensile residual stress in the outer side of the steel pipe thereby easily causing a larger tensile stress than the yielding stress of the material of the pipe. An excessively large tensile stress as described above results in a breakage of the steel pipe from the outer side.

In JP-A-57-177924, with an expanding of a steel pipe in cold condition, in an installed steel pipe which has been used in a plant once before being subjected to thermal treatment or even a new steel pipe, when the new steel pipe is defective at an inner side thereof, a defect existing in the inner side of the steel pipe is enhanced with the force of expanding of the steel pipe easier in a cold condition than in a high temperature condition, and a possibility of increasing a breakage factor arises. Further, it is also possible for an increase in the breakage to arise because the higher pressure is used for the expanding of the steel pipe is performed only by an internal pressure.

SUMMARY OF THE INVENTION

The aim underlying the present invention essentially resides in providing a method and apparatus to strengthen a pressure resistance property of a hollowed metallic structure so as to prevent a breakage thereof as well as to provide a hollowed metallic structure having the desired pressure resistance property in use.

In accordance with the method of the present invention, a temperature differential is provided between two sides in the thickness direction of the hollowed metallic structure, that is, between an inner side and an outer side of the structure to an extent that a stress caused by the temperature differential is not beyond a yielding stress of the metallic material of the hollowed structure, providing a pressure to one of the inner or outer sides of the hollowed structure until a stress in the pressurized side reaches the yielding stress of the metallic material, and a subsequent releasing of the pressure.

In the method of the present invention, the temperature differential provided between the inner and outer sides of the hollowed structure, to the extent that a stress caused by the temperature differential does not exceed the yielding stress of the metallic material of the hollowed structure, generates a compressive stress in the higher temperature side and a tensile stress in the lower temperature side to the extent not exceeding the yielding stress of the metallic material. Under a condition described above, providing of a further additional pressure to the lower temperature side causes an additional tensile stress in the lower temperature side, and consequent superimposition of the additional tensile stress on the tensile stress which is caused by the temperature differential generates a larger tensile stress than the yielding stress of the metallic material in the lower temperature side.

Although an additional tensile stress caused by providing the pressure is added concurrently to the higher temperature side, the compressive residual stress in the higher temperature side offsets the additional tensile stress and a consequent superimposed stress at the higher temperature side would scarcely reach the yielding stress of the metallic material, and therefore causing a tensile yielding only in the lower temperature side becomes possible.

A pressure release after passing through the condition described above causes a compressive residual stress in the lower temperature side where the superimposed tensile stress exceeded the yielding stress and an original stress-strain relationship of the metallic material is not maintained. Even though the other side does not experience tensile yielding and maintains the original stress-strain relationship, an existence of the compressive residual stress at a reverse side effects and causes a tensile residual stress in the higher temperature side. But, the absolute value of the maximum tensile residual stress in the higher temperature side is far less than the absolute value of the maximum compressive residual stress in the lower temperature side due to a biased balancing position of stresses to a point near the lower temperature side where yielding occurred.

With the method of the present invention, a hollowed metallic structure having a compressive residual stress, which has a larger absolute value in a side in contact with a high pressure fluid than an absolute value in a reverse side and offsets a tensile stress which is caused during use of the hollowed structure is obtainable.

In accordance with a alternative method of the present invention, a stress field is provided having a different direction in each of the respective inner and outer sides of the metallic hollowed structure to an extent not exceeding a yielding stress of the metallic material, providing a further additional stress externally to one of the inner and outer sides of the hollowed metallic structure in the same direction as the stress field to cause a yielding of the metallic material in the one side thereof, and releasing of the stress provided externally to the hollowed metallic structure after causing the yielding of the metallic material of the hollowed structure.

In the above-described alternative method, with a stress field having different directions in each of the two sides of the hollowed structure to the extent of not exceeding the yielding stress of the metallic material of the hollowed structure, the further additional stress is provided externally to one of two sides of the metallic material in the same direction as the stress field so as to cause the yielding of the metallic material in the one side of the metallic material, while the other side of the metallic material far from the side causing the yielding is not yielded. And releasing of the external stress applied to the metallic material of the hollowed structure after the yielding is caused in the one side of the metallic material as described above. Releasing of the external stress causes a residual stress in the yielded side, which has the reverse direction and larger absolute value than the residual stress in the other side, and the hollowed structure having strengthened pressure resistance is obtained because of the residual stress in the yielded side offsets a stress which is generated with pressurization of the hollowed structure in operation or use.

In accordance with yet another method of the present invention, for strengthening pressure resistance of a metallic hollowed structure, a stress is applied to the metallic material by heating one of the two sides, that is, an inner side and an outer side of the metallic material and the opposite side is cooled to such an extent that a stress generated with the heating and the cooling is not beyond a yielding stress of the metallic material of the hollowed structure, and a further additional external stress is applied to one of the two sides in the same direction as the stress generated by the heating and the cooling to cause a superimposed stress beyond the yielding stress of the metallic material, with the external stress being released after passing through the condition described above.

In the method described above, the stress is provided to the metallic material by heating of one side and cooling of the other side of the metallic hollowed structure to such an extent that the stress generated with the heating and the cooling would not be beyond the yielding stress of the metallic material. A method to provide a stress by cooling is easier in causing a temperature differential between the respective sides of the structure. After providing the temperature differential to the extent that the stress caused by the temperature differential would not exceed the yielding stress of the metallic material, the additional external stress is provided to one of the two sides in the same direction as the stress provided by the heating and the cooling to cause the superimposed stress beyond the yielding stress of the metallic material, and the other side far from the side causing the yielding does not yield. Releasing of the additional external stress after passing through the condition described above causes, in the yielded side, a residual stress having a reverse direction and a larger absolute value than the residual stress in the unyielded side, and the hollowed structure has a strengthened pressure resistance because of the residual stress in the yielded side offsets the stress generated with pressurization of the hollowed structure in operation or use.

In accordance with still further features of the present invention, for stiffening pressure resistance of a metallic hollowed structure, a stress is applied to the metallic material by heating of an outer side and cooling of an inner side of the hollowed structure to such an extent that a stress generated with the heating and the cooling is not beyond a yielding stress of the metallic material of the hollowed structure, with an additional stress being applied to the inner side of the hollowed structure by imparting an internal pressure to an internal cavity of the hollowed structure to cause a superimposed stress beyond the yielding stress of the metallic material of the hollowed structure, and the internal pressure being released after passing through the condition described above.

In the method described above, the stress is provided to the metallic material by heating of the outer side and cooling of the inner side of the hollowed structure to the extent that the stress generated with the heating and the cooling is not beyond the yielding stress of the metallic material of the hollowed structure. A method to provide a stress by cooling is easier in creating a temperature differential. After providing the temperature differential causing the stress to the extent of not exceeding the yielding stress of the metallic material, the further additional stress is provided to the inner side of the hollowed structure by applying the internal pressure to the internal cavity of the hollowed structure to cause the superimposed stress beyond the yielding stress of the metallic material of the hollowed structure, but the other side far from the pressurized side, that is, the outer side does not yield. Releasing of the pressure after passing through the condition described above causes the residual stress in the yielded side which has a reverse direction and a larger absolute value than the residual stress in the unyielded side, and a hollowed structure having strengthened pressure resistance is obtained because of the residual stress in the yielded side offsets a stress generated with pressurization of the hollowed structure in operation of use.

In accordance with yet additional feature of the method of the present invention, for strengthening pressure resistance of a metallic hollowed structure, coolant flows in an internal cavity of the hollowed structure, with the coolant having a pressure for causing a stress to the metallic material less than a yielding stress of the metallic material, with the hollowed structure being heated during the flow of coolant by a heating means which moves along an axial direction of an outer side of the hollowed structure to give enough heat to generate a stress beyond the yielding stress of the metallic material to the inner side of the hollowed structure and a stress less than the yielding stress of the metallic material to the outer side of the hollowed structure.

In the last-described method, the coolant, having a pressure for causing the stress to be less than the yielding stress to the metallic material, flows in the cavity of the hollowed structure. The metallic material does not yield with only the pressure of the coolant. But, when a heat is supplied to the hollowed structure with the heating means which moves along the axial direction of the outer side of the hollowed structure during the flow of the coolant, the heat is removed from the inner surface of the hollowed structure by the flow of coolant faster than with the use of a stagnant coolant, and the outer surface of the hollowed structure receives heat from the heating means. Consequently, a temperature differential is provided in the direction of thickness of the metallic material of the hollowed structure. The temperature differential causes stress both in the inner side and the outer side in reverse directions, respectively, and the stress in the inner side is superimposed on the stress generated by the pressure of the coolant in the same direction, while the stress in the outer side is offset with the stress generated by the coolant in the reverse direction, and only the superimposed stress in the inner side exceeds the yielding stress of the metallic material. Subsequent releasing of the pressure of the coolant after a completion of the moving of the heating means causes a residual stress in the yielded side which has a reverse and larger absolute value than a residual stress in the unyielded side, and a hollowed structure having strengthened pressure resistance is obtained because of the residual stress in the yielded side offsets a stress which will be caused by an internal pressure of the hollowed structure in operation or use.

In accordance with the apparatus of the present invention, a high frequency oscillation coil of a high frequency oscillator is arranged with a gap around an outer side of the hollowed structure to be treated, with an apparatus being provided to transfer the high frequency oscillation coil in an axial direction of the hollowed structure, an inlet and an outlet for coolant supplied to the hollowed structure in the axial direction along which the high frequency oscillating coil moves, a pump is provided for pumping the coolant from the inlet to the outlet, and an apparatus is provided for pressurizing the coolant.

With the apparatus of the present invention, the outer side of the hollowed structure is heated with the high frequency oscillation coil of the high frequency oscillator so as to generate a temperature differential between two sides of the structure, that is, the inner side and the outer side of the hollowed structure, and the temperature differential causes stresses in a different direction in the outer side and the inner side, respectively. With the stresses being applied, the pressurized coolant flows from the inlet to the outlet by the pumping action of the coolant pump.

As the flow of the coolant enhances cooling at the inner side of the hollowed structure, the temperature differential becomes larger than the temperature differential before the coolant flow. As the coolant is pressurized, a stress, caused by the pressure of the coolant, is larger at the inner side of the hollowed structure than at the outer side of the hollowed structure. A direction of the stress caused by the pressure of the coolant is the same as that of the stress caused by the temperature differential in the inner side and reverse in the outer side of the hollowed structure; therefore, the stress provided by the temperature differential is superimposed on the stress caused by the pressure of the coolant to be beyond the yielding stress of the metallic material of the hollowed structure in the inner side of the hollowed structure, but the stress provided by the temperature differential in the outer side of the hollowed structure offsets the stress caused by the pressure of the coolant and a superimposed stress is below the yielding stress of the metallic material of the hollowed structure. After the heating is finished and the pressure of the coolant is released, a residual stress in a reverse direction is generated in a side where the metallic material was yielded, with the residual stress having a larger absolute value than a residual stress in a side where none of the metallic material was yielded. And a hollowed structure having a strengthened resistance to pressure is able to be obtained because the residual stress in the inner side of the hollowed structure offsets a stress caused by an internal pressure which is added to the hollowed structure in operation or use.

In the present invention, a metallic hollowed structure adapted to withstand an internal pressure comprises an inner side which has a compressive residual stress of a larger absolute value than a tensile stress which is caused in the inner side by the internal pressure described above, and an outer side which has a tensile residual stress, whereby, even though a tensile stress caused by the internal pressure is superimposed, the superimposed stress is still less than the yielding stress of the metallic material of the pressure resistant hollowed structure.

With the pressure resistant hollowed structure of the present invention as described above, the superimposed stress is still less than the yielding stress of the metallic material of the pressure resistant hollowed structure, even if an internal pressure is increased during operation or use, the stress added to the hollowed structure by the increased pressure is a tensile stress having a distribution which is larger at the inner side and less at the outer side.

Among the stress provided to the hollowed structure by the raised pressure, the larger tensile stress in the inner side is reduced by offsetting of the compressive residual stress described above, and even though the smaller tensile in the outer side is superimposed on the tensile residual stress described above, both of the values of the residual stress and the stress caused by the internal pressure in the outer side are small enough to make the superimposed stress of both of the residual stress and the stress caused by the internal pressure to be less than the yielding stress of the metallic material of the hollowed structure, and it is possible to maintain a high pressure resistance property.

According to the present invention, the metallic hollowed structure may be used for maintaining a compressive residual stress having an absolute value larger than a tensile stress caused by a internal pressure of the hollowed structure in the inner side of the hollowed structure made of the metallic material, and maintaining of a tensile residual stress in the outer side of the hollowed structure. The tensile residual stress in the outer side of the hollowed structure has a small value even though a tensile stress, caused by the internal pressure, is additionally provided, the superimposed stress is still under the yielding stress of the metallic material of the hollowed structure in order to accommodate the tensile stress caused by the internal pressure of the hollowed structure by offsetting with the compressive residual stress in the inner side of the hollowed structure within a range not exceeding the yielding stress of the metallic material and by superimposing on the residual tensile stress in the outer side of the hollowed structure within the yielding stress of the metallic material of the hollowed structure.

With the method described above, the large tensile stress caused by the internal pressure of the hollowed structure in the inner side of the hollowed structure is offset by the compressive residual stress in the inner side within a range not exceeding the yielding stress of the metallic material of the hollowed structure, and the tensile stress caused by the internal pressure of the hollowed structure in the outer side, which is relatively smaller than the tensile stress in the inner side, is superimposed with the tensile residual stress in the outer side within a range not exceeding the yielding stress of the metallic material of the hollowed structure, and, consequently, the stress caused by the internal pressure of the hollowed structure is accommodated with the hollowed structure and an integrity of the hollowed structure to the internal pressure is improved even though the hollowed structure is used with high internal pressure.

DESCRIPTION OF PREFERRED EMBODIMENTS

Figure 1:
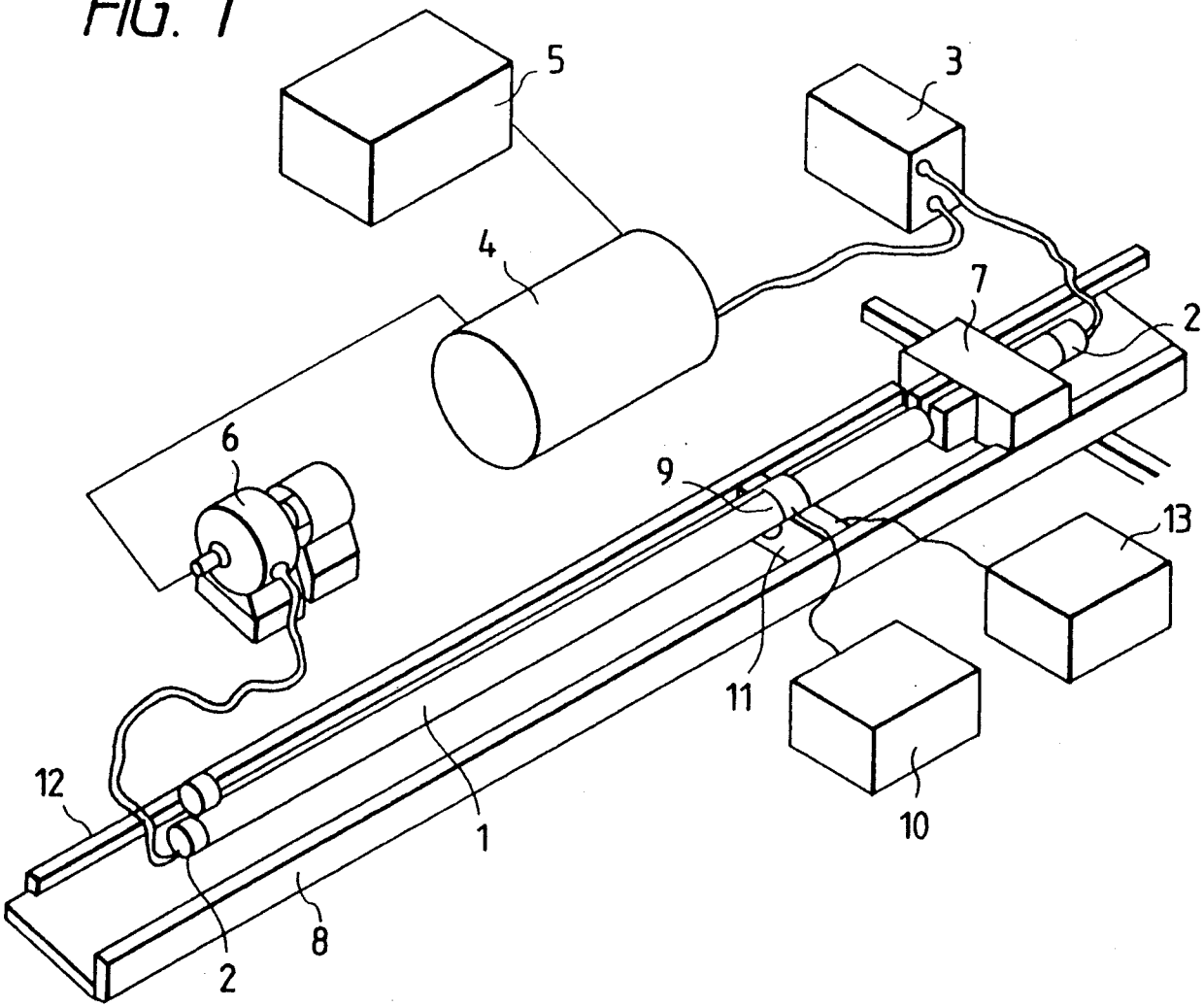
FIG. 1 is a schematic perspective view of an apparatus for heat treatment and pressurization in accordance with a first embodiment of the present invention.

Referring now to the drawings wherein like reference numerals are used throughout the various views to designate like parts and, more particularly, to FIG. 1, according to this figure, a pipe 1 used, for example, in a nuclear power plant of a heavy water moderated light water cooled pressure tube type reactor forms a boundary of a first coolant of the nuclear reactor. The pipe 1 has a thick wall and, for example, may be dimensioned as follows:

Outer diameter: 89.1 mm,
Inner diameter: 66.9 mm,
Thickness of wall: 11.1 mm, and
Quality: 80Asch160.

As shown in FIG. 1, the pipe 1 is sealed at both ends with plugs and contains a coolant inside there, with the coolant being, for example, water. The water in the pipe 1 is discharged through a nozzle (not shown) of the plug 2 attached to the right end of the pipe 1, enters into a cooler 3 through a piping and is cooled to an arbitrary temperature. The water cooled in the cooler 3 is supplied to a coolant tank 4 through a piping. The water in the coolant tank 4 is pressurized to an arbitrary pressure with a compressor 5 and is maintained at a constant pressure. The water in the coolant tank 4 is supplied into the pipe 1 at a constant rate by a circulation pump 6 through a nozzle (not shown) of the plug 2 attached at the left side of the pipe 1, and the water thus circulates.

A clamp 7 holds the pipe 1 relative to a guide rail 8 installed along the pipe 1. A high frequency oscillation coil 9 is arranged around the pipe 1 without any contact. High frequency current is supplied to the high frequency oscillation coil 9 from a high frequency oscillator 10, and the pipe 1 is heated with high frequency wave oscillations from the high frequency oscillation coil 9.

The high frequency oscillation coil 9 is fixed on a slider 11, with a driving motor D being attached to the slider 11, and a pinion which is rotated and driven with the driving motor D meshes with a rack 12 installed on the guide rail 8. The driving motor D is regulated to rotate at a constant speed with a controller 13. As the pinion, driven with the driving motor D, meshes with the rack 12, the slider 11 is able to move with the high frequency oscillation coil 9 at a constant speed along the pipe 1.

In the condition described above, a part of the pipe 1, near the high frequency oscillation coil 9, is heated by the high frequency oscillation coil 9 and is cooled internally with water, and, consequently, a temperature differential between an inner side and an outer side of the pipe 1 is caused, and a tensile stress in the inner side of the pipe 1 and a compressive stress in the outer side of the pipe 1 are generated.

The driving motor D is regulated to rotate at a constant speed and moves the high frequency oscillation coil 9 slowly along the pipe 1. As the high frequency oscillation coil 9 moves, a heated position of the pipe 1 changes gradually and almost all the pipe is treated with the heat treatment described above.

The moving speed of the high frequency oscillation coil 9 is regulated so as to cause a pipe temperature to cause a compressive stress in the pipe 1, with the compressive stress being generated only by the temperature differential between the inner side and the outer side of the pipe 1 at the heated position of the pipe 1, close to but not beyond the compressive yielding stress in the outer side of the pipe 1.

The compressive stress caused by the temperature differential between the inner side and the outer side of the pipe 1 is within a range under the yielding stress by regulating the moving speed of the high frequency oscillation coil 9. Therefore, any plastic deformation of the pipe 1, depending only on the temperature differential between the inner side and the outer side of the pipe 1, is not generated, and any residual stress is not provided.

But, as pressurized water of the coolant is contained inside of the pipe 1 as described above, the tensile stress caused by the internal water pressure is added in the circumferential direction of the pipe 1, which is almost the same direction as the direction of stress generated with the temperature differential. Consequently, a total stress generated in the pipe 1 is a sum of the stress caused by the internal water pressure, that is, the internal pressure of the pipe 1, and the stress caused by the above-described temperature differential.

An actual stress generated in the circumferential direction of the pipe 1 is beyond the tensile yielding stress in the inner side because the stress caused with the internal pressure is superimposed on the stress generated by the temperature differential, which is near to the tensile yielding stress, and causes a tensile yielding. On the other hand, the stress generated by the temperature differential offsets the stress caused by the internal pressure in the outer side of the pipe 1, and an actual stress generated in the outer side of the pipe 1 is not beyond the tensile yield stress.

Figure 2:
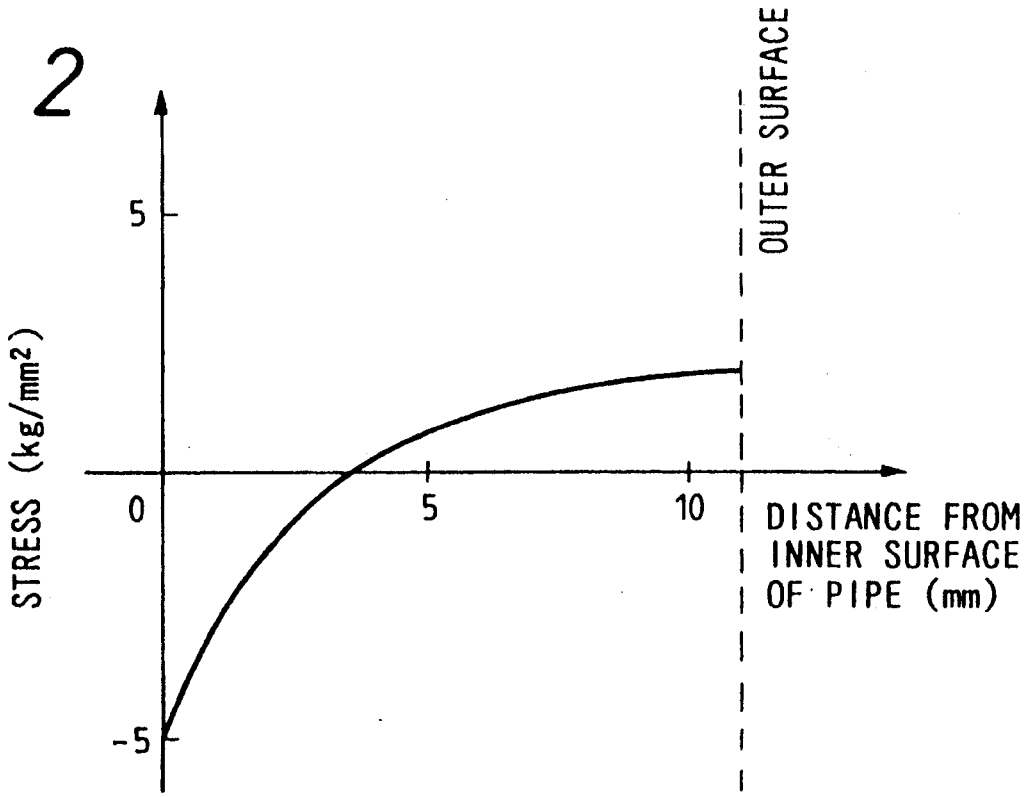
FIG. 2 is a graphical representation of a distribution of residual stress in the pipe treated in the embodiment of FIG. 1.

After finishing the thermal and pressuring treatment described above, all through the moving range of the high frequency oscillation coil 9, the oscillating of high frequency waves from the high frequency oscillation coil 9 is stopped, and the operation of the circulation pump 6 and the compressor 5 are stopped. Depending on the procedure described above, the temperature of the pipe is lowered and the internal pressure of the pipe is released. The releasing of the internal pressure generates a compressive residual stress in the inner side of the pipe 1 and a tensile residual stress in the outer side of the pipe 1. The residual stresses described above are caused by a plastic deformation of the inner side of the pipe 1, and residual stresses in the circumferential direction of the pipe in the inner side and the outer side of the pipe 1 have values near the compressive yielding stress in the inner side and less than a half of the tensile yielding stress in the outer side, respectively, as shown in FIG. 2.

As described above, the residual stress of the pipe 1 in the circumferential direction has a biased distribution.

Generally speaking, a stress in a circumferential direction of a pipe with an internal pressurization is expressed in accordance with the following equation.

$$\sigma t = \frac{pi \cdot ri^2}{r_0^2 - r_1^2}\left(1 + \frac{r_0^2}{r^2}\right) \quad (1)$$

where:

$\sigma t$: Generated stress (circumferential direction), pi: Internal pressure, $r_0$: Outer radius, ri: Inner radius, and r: Distance (radius) from the center to the point calculated the stress.

A ratio of the maximum stress $\sigma_{max}$ in the inner side ($r=r_i$), of the pipe 1 and the minimum stress $\sigma_{min}$ in the outer side ($r=r_O$) of the pipe 1 is expressed as follows:

$$\frac{\sigma_{max}}{\sigma_{min}} = \frac{1}{2}\left\{1 + \left(\frac{r_0}{r_i}\right)^2\right\}$$

Figure 3:
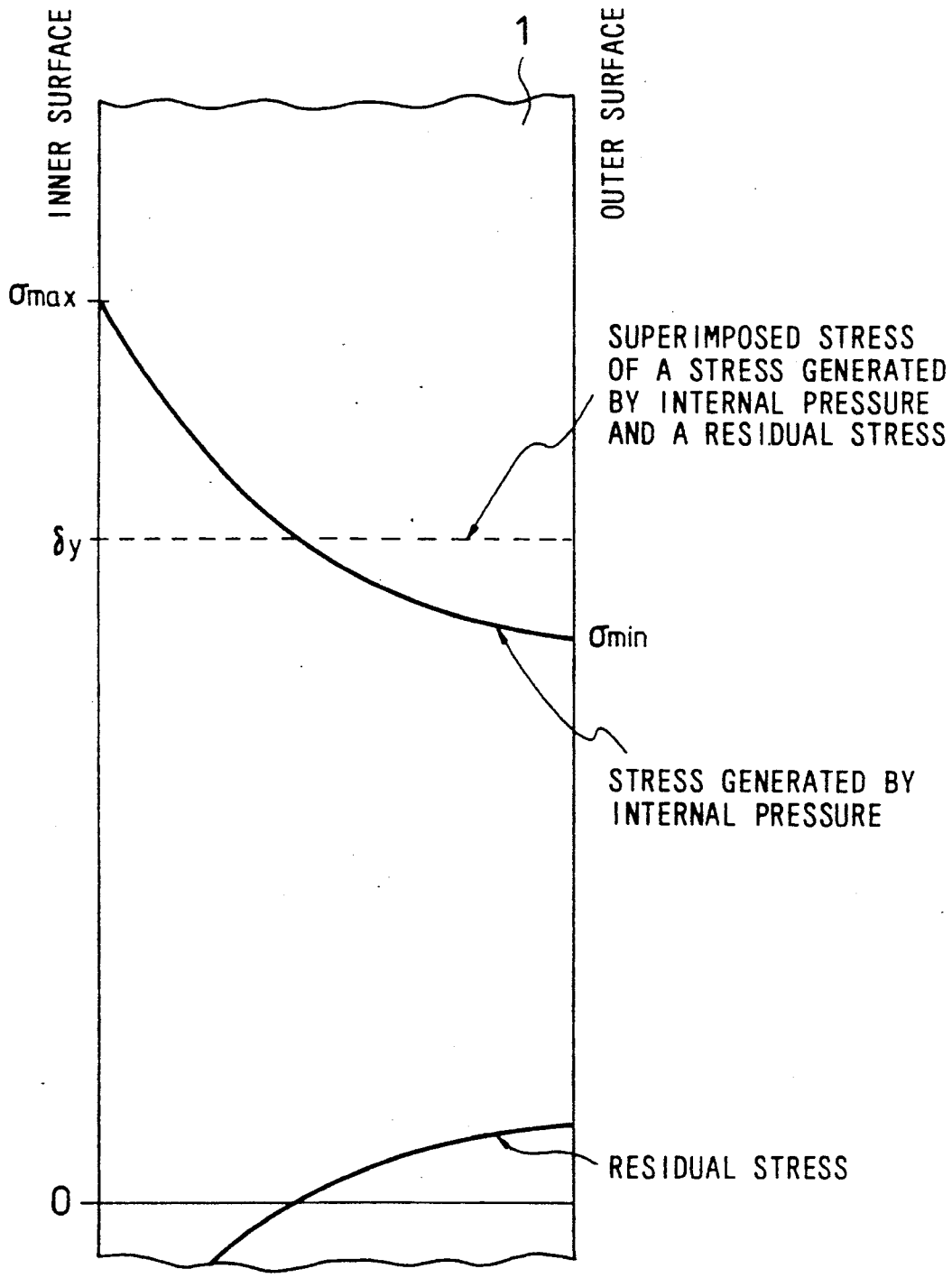
FIG. 3 is a graphical illustration of a distribution of stress caused by internal pressure in a pipe treated in accordance with the embodiment of FIG. 1 and the distribution of superimposed stress caused by internal pressure of the pipe and residual stress of the pipe.

In the embodiment of the present invention, $$\frac{\sigma_{max}}{\sigma_{min}} = 1.386,$$

where:

$r_0 := 44.55$ mm, $r_i := 33.345$, and a distribution of stresses is such as shown in FIG. 3.

When an excess internal stress is provided to the pipe 1, the stress in the inner side, $\sigma_{max}$ of the pipe 1 becomes larger than the yielding stress first and the pipe 1 would be ruptured.

Therefore, an allowable internal pressure of the pipe 1 is generally designated so that $\sigma_{max}$ does not exceed the yielding stress. But, when a residual stress such as shown in FIG. 2 in a pipe generated by the thermal treatment and pressurization as described in the embodiment of the present invention exists, an actual superimposed stress has a tendency to be a uniform distribution as shown in FIG. 3 with a dotted line, and, consequently, $\sigma_{max}$ is decreased and pressure resistance of the pipe is increased.

Further, as a compressive residual stress remains in the inner side of the pipe 1 with the embodiment of the present invention, a strength for a corrosion fatigue is increased remarkably.

And further, a pipe having the same pressure resistance as a conventional pipe is able to be obtained with a thinner wall. Consequently, a pipe relating to the present invention makes it possible to respond to temperature change more flexibly during an operation of a commercial plant.

A reason to generate a biased residual stress in the inner side of pipe 1 is described hereinafter.

Figure 4:
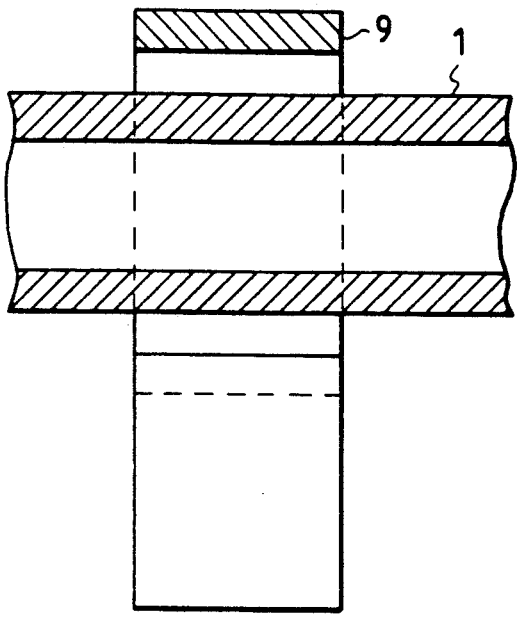
FIG. 4 is a schematic longitudinal cross-sectional view of a relationship between the oscillation coil and the pipe in FIG. 1.
Figure 5:
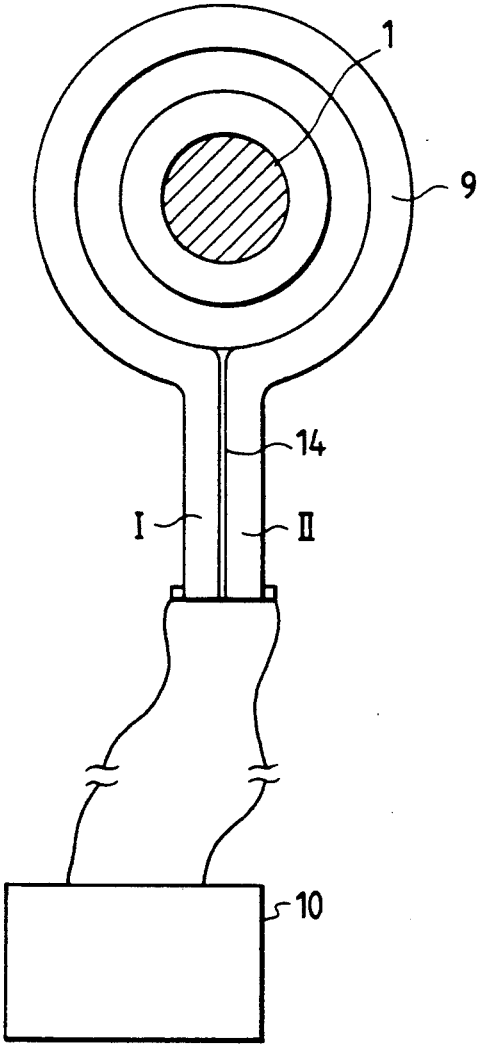
FIG. 5 is a schematic cross-sectional view of a relationship between the oscillation coil and the pipe in FIG. 1, taken in a direction perpendicular to a longitudinal axis of the pipe.

As shown in FIGS. 4 and 5, the pipe 1 is surrounded with the high frequency oscillation coil 9 of an apparatus for high frequency heating which is of a kind of an apparatus for induction heating, and a constant gap exists between the high frequency oscillation coil 9 and circumferential surface of the pipe 1.

Both ends I, II of the high frequency oscillation coil 9, in FIG. 5, are insulated with an electrical insulator 14, and high frequency current is supplied from the high frequency oscillator 10 to the ends I, II through electric wires.

The high frequency oscillation coil 9 surrounding the pipe 1 is preferably fashioned of two parts jointed so as to surround the pipe 1 laterally in order to facilitate attachment of the high frequency oscillation coil 9 to the pipe 1.

Figure 6:
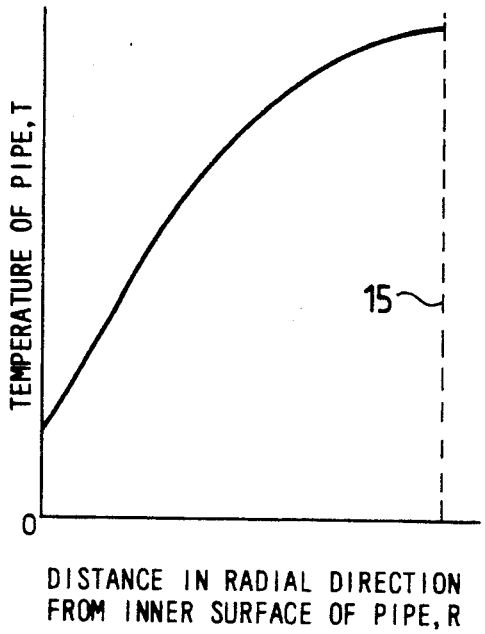
FIG. 6 is a graphical illustration of the temperature distribution in a pipe treated in the embodiment of FIG. 1.
Figure 7:
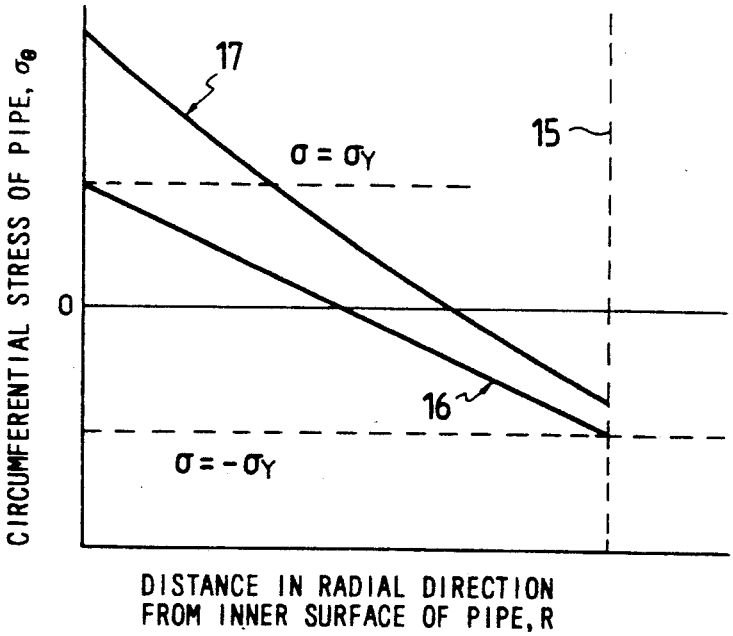
FIG. 7 is a graphical illustration of the stress distribution in the pipe showing the distribution of the generated stress by only the heat treatment and the distribution of the generated stress by the heat treatment and pressurizing treatment in the embodiment of FIG. 1.

Pressurized water flows as a coolant contacting the inner surface of the pipe 1; however, when water is not flowing in the pipe 1, a wall of the pipe 1 is heated homogeneously in the radial direction with high frequency waves from the high frequency oscillation coil 9. In practice, as water as a coolant circulates or flows inside the pipe 1, heat is removed through an inner wall of the pipe 1 and a temperature distribution in a radial direction of the pipe 1 has a trend as shown in FIG. 6. FIG. 7 shows a trend of stress distribution generated by the temperature distribution shown in FIG. 6, with FIG. 8 graphically depicting a relationship between stress and strain. A dashed line 15 in FIGS. 6 and 7 shows a position of the outer surface of the pipe 1.

Figure 8:
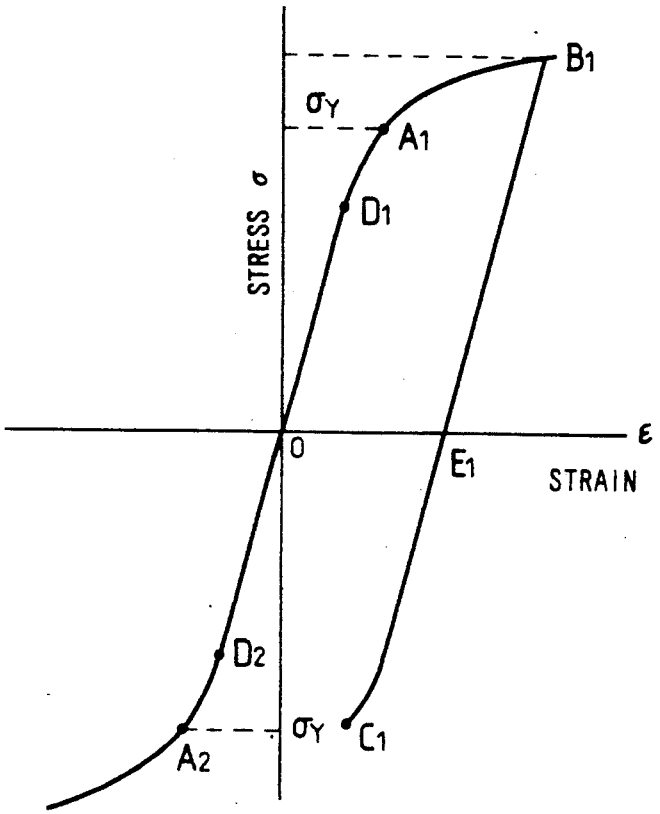
FIG. 8 is a graphical illustration showing a relationship between stress and strain of a pipe in the embodiment of FIG. 1.

When the temperature differential between the outer side and the inner side of the pipe 1 is small, stresses both in the outer side and the inner side of the pipe 1 do not exceed the yielding stress of the pipe 1, and proportionality of a stress-strain relationship is maintained as shown in FIG. 8, depicting the relationship existing about a straight line between O-$D_2$ as for the outer side of the pipe 1 and O-$D_1$ as for the inner side of the pipe 1, with both strains in the outer side and the inner side of the pipe 1 returning to zero as shown in FIG. 8 by stopping the high frequency heating of the pipe 1.

Figure 9:
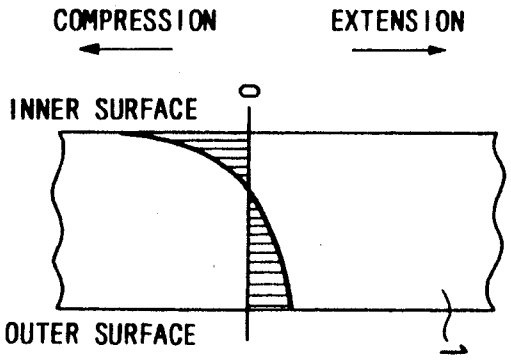
FIG. 9 is a graphical illustration of the residual stress distribution in the pipe after the treatment in the embodiment of FIG. 1.

A stress distribution in a radial direction of a wall of a pipe under heating is depicted as a straight line 16 in FIG. 7. In the present embodiment, as the maximum stress with temperature difference is set just under the yielding stress $\sigma_y$, an additional providing of a s tress which is generated with an inner pressurization by hydraulic pressure causes such a stress distribution in a radial direction of the wall of the pipe 1 as shown as a line 17 in FIG. 7, and the stress in the inner side of the pipe 1 exceeds the tensile yielding stress $\sigma_y$ of the pipe 1. The stress is designated as $B_1$ in FIG. 8. By terminating the heating when the stress reaches the point $B_1$, the stress of the inner side of the pipe 1 is released from $B_1$ to $C_1$ thorough $E_1$. On the other hand, stress in the outer side of the pipe 1 does not exceed the yielding stress of the pipe 1 and remains within a range between O and $D_2$ in FIG. 8 and any residual stress would not remain after the termination of heating. But, actually, as a compressive residual stress remains in the inner side of the pipe 1, a tensile stress which offsets the compressive residual stress is caused in the outer side and a balance of stresses in the outer side and in the inner side of the pipe 1 is fulfilled. A trend of the residual stress distribution at the moment the balance is attained has a bias to the inner side of the pipe 1 as shown in FIG. 9.

Figure 10:
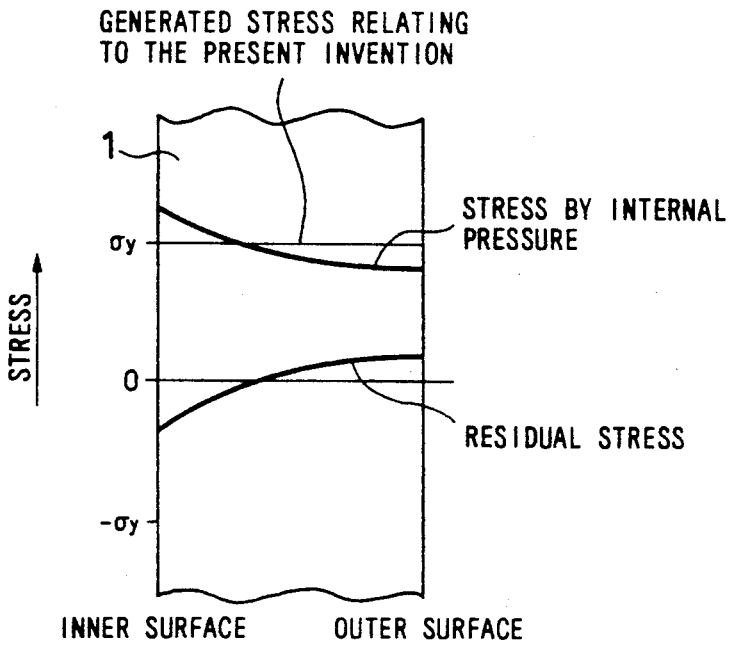
FIG. 10 is a graphical illustration of stress distribution showing the residual stress distribution in the pipe after the treatment in the embodiment of FIG. 1 and the distribution of the stress caused by the internal pressure in the pipe in actual use, and the distribution of the generated stress in actual use.
Figure 11:
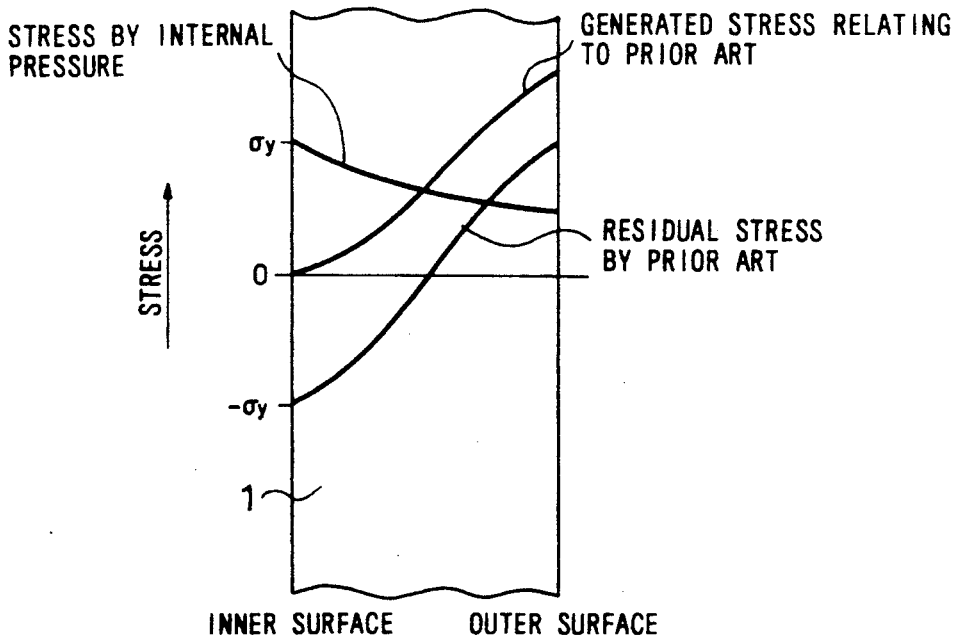
FIG. 11 is a graphic illustration of stress distribution showing the residual stress distribution in the pipe after only the heat treatment in the embodiment of FIG. 1, the distribution of the stress caused by the internal pressure in the pipe in actual use, and the distribution of generated stress in actual use.

FIG. 10 illustrates a residual stress relating to the present invention, a stress generated with the internal pressure of the pipe in operation or use, and a superimposed actual stress generated in the pipe 1 in operation or use. And, FIG. 11 illustrates a residual stress relating to a prior art arrangement, a stress generated by the internal pressure of the pipe in operation or use, and a superimposed actual stress generated in the pipe 1 in operation or use.

In the prior art, absolute values of residual stresses in the outer side and in the inner side of the pipe 1 are even, and when putting the residual stress in the inner side of the pipe 1 as $-\sigma_y$ which is close to an absolute value of the yielding stress $|\sigma_y|$, the residual stress in the outer side is expressed as $+\sigma_y$. And when an internal pressure is supplied to the pipe 1 in operation, as the stress generated with the internal pressure is tensile (+stress), a superimposed stress in the outer side of the pipe 1 easily exceeds the yielding stress of the pipe 1 and a yielding occurs.

On the other hand, in the embodiment of the present invention, even though a residual stress $-\sigma_y$ near to the yielding stress remains in the inner side of the pipe 1, only a far smaller tensile residual stress (+stress) than the prior art remains in the outer side of the pipe as shown as a right side area from the point where the stress is zero in FIG. 10. Therefore, in the embodiment of the present invention, even though the tensile stress $\sigma_y$ in FIG. 10 which is generated by the internal pressure of the pipe (equal to the stress by the internal pressure in FIG. 11) is added to the inner side of the pipe, a superimposed stress in the outer side of the pipe 1 will not exceed $+\sigma_y$, and an integrity of the pipe 1 will be maintained. Consequently, pressure resistance of the pipe 1 is improved by the present invention.

A steel pipe 1 made of austenitic stainless steel having a schedule number of 80ASch160 is surrounded with a high frequency oscillation coil 9. A circulating pump 6 is driven, and cooling water having a pressure of 200 kg/cm$^2$ and a temperature of 30° C. is circulated through the pipe 1 with a speed of 0.43 m/s.

The pipe 1 is heated with the high frequency oscillation coil 9 which is moving along an axial direction of the pipe 1 with a speed of 0.5 mm/s with oscillating a high frequency wave of 3.0 kHz.

Figure 12:
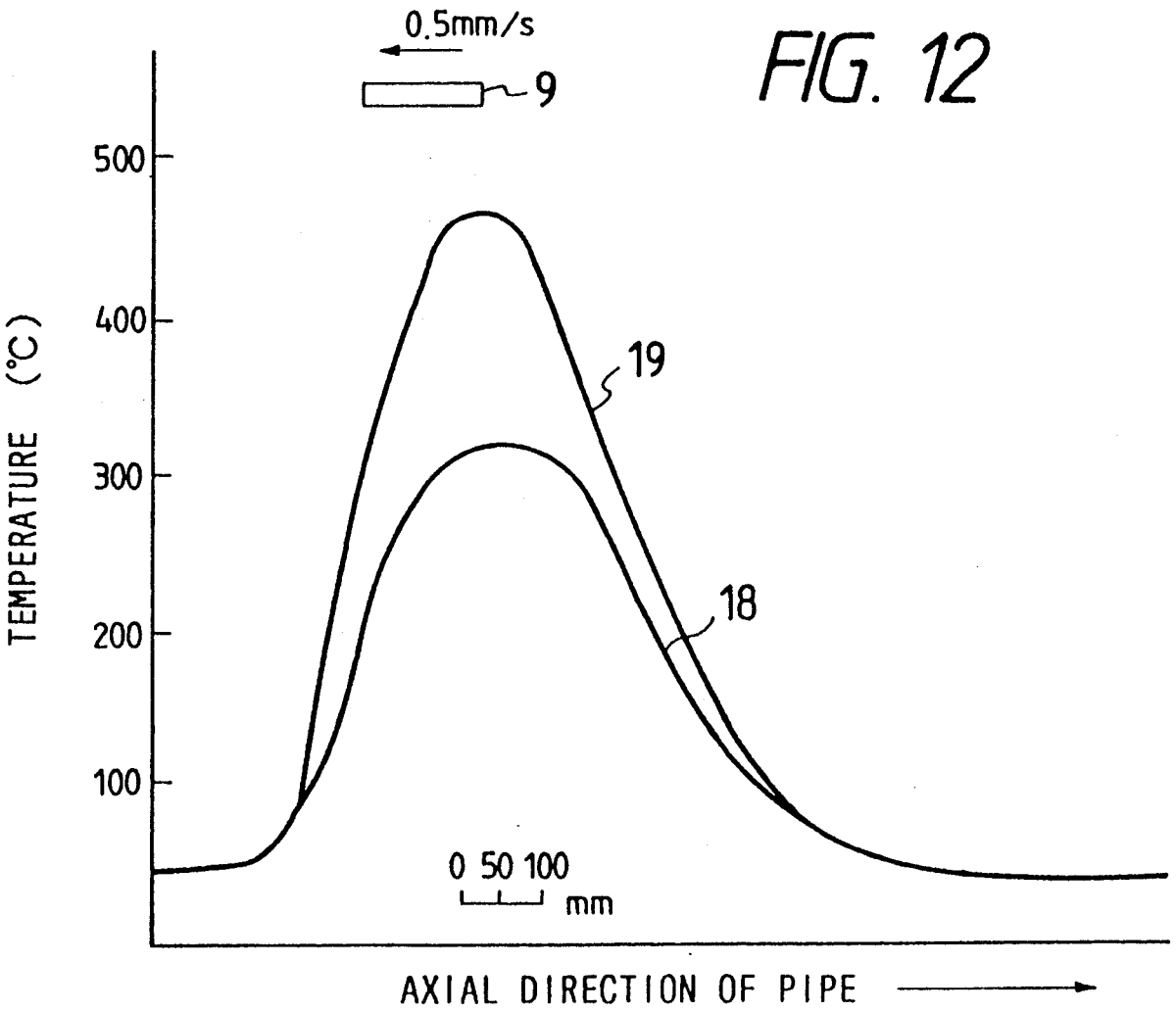
FIG. 12 is a graph of the temperature distribution showing the relationship between the position of the high frequency oscillation coil in FIG. 1 and the temperature of the pipe.

FIG. 12 illustrates a relationship between a position of the high frequency oscillation coil 9 and temperature of the pipe. As the high frequency oscillation coil 9 is moving with a speed of 0.5 mm/s, a place of the highest temperature of the pipe is based about 100 mm from the middle of the pipe in the axial direction. The temperature distribution in the outer side and the inner side of the pipe 1 are shown as a curve 18 and a curve 19, respectively, in FIG. 12.

Under the conditions described above, the temperature differential between the outer side and the inner side of the pipe becomes about 190° C. A stress $\sigma$ generated With a temperature differential $\Delta T_1$ between the outer side and the inner side of the pipe is generally expressed in the following equation:

$$\sigma = \pm \frac{1}{2(1-\nu)} E\alpha|\Delta T|,$$

where:

E=Young's modulus, $\mu$=Poisson's ration, and $\alpha$=Thermal expansion coefficient.

When $\sigma$ becomes greater than $\sigma_y$ (yielding stress), a plastic deformation occurs and a residual stress remains after cooling.

Figure 13:
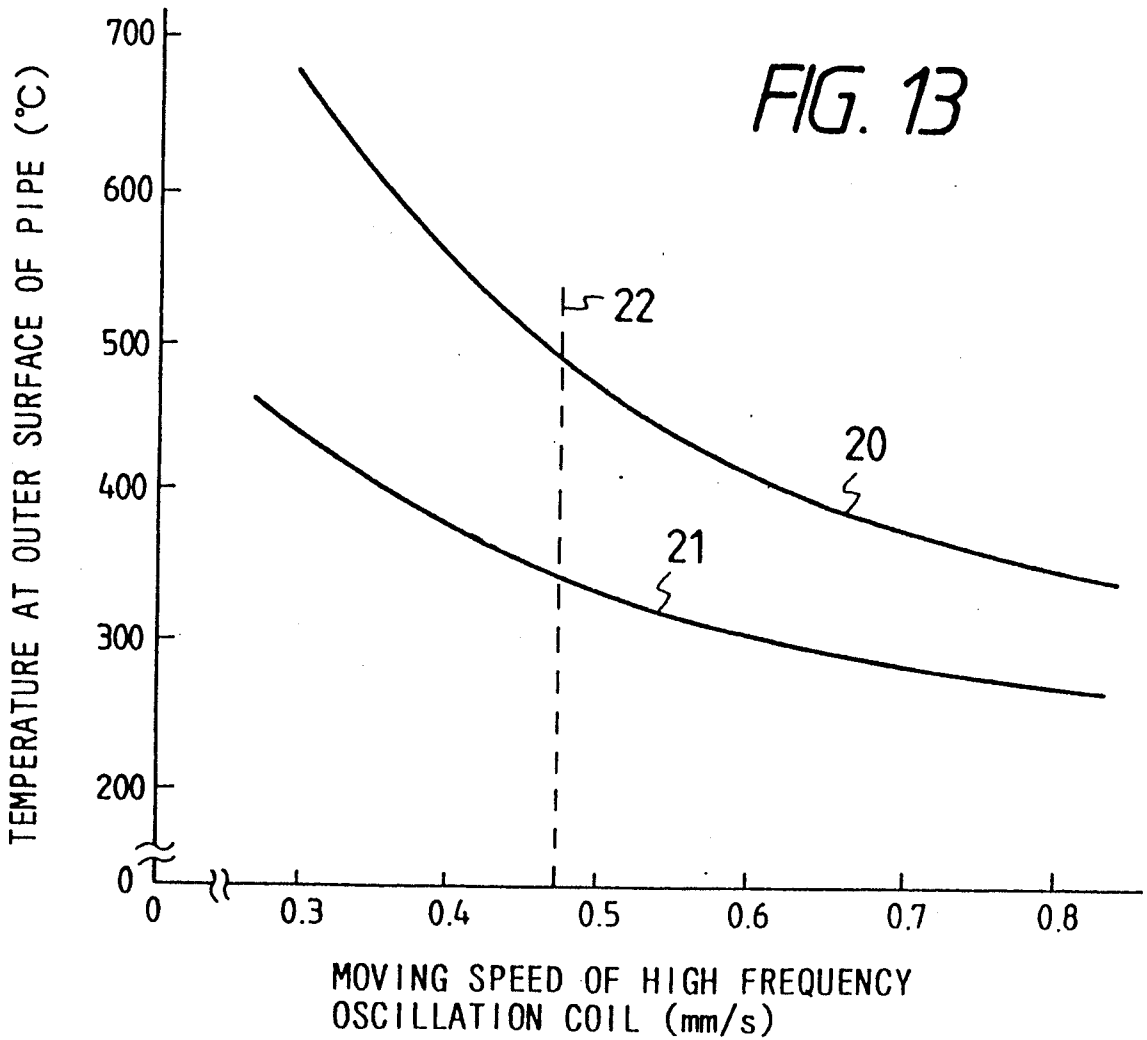
FIG. 13 is a graph of the temperature distribution showing the relationship between the moving speed of the high frequency oscillation coil in FIG. 1 and the temperature of the pipe.

FIG. 13 illustrates a relationship between a moving speed of a high frequency oscillation coil 9 and a temperature in the outer side and the inner side of the pipe 1. A trend that the faster the high frequency oscillation coil 9 moves, the lower the heating temperature of the pipe 1 becomes, and the slower the high frequency oscillation coil 9 moves, the higher the heating temperature of the pipe becomes. In FIG. 13, the temperature at the inner side of the pipe 1 is represented by a curve 21 and the temperature at the outer side is represented by a curve 20, respectively. A dashed line 22 illustrates a boundary between a region where a residual stress remains after thermal treatment and cooling without internal pressure in the pipe 1 (left side region) and a region where any residual stress does not remain (right side region). In the present embodiment, 0.5 mm/s, a value near the boundary represented by the line 22 in FIG. 13, is selected as a moving speed of the high frequency oscillation coil 9. A residual stress near the yielding stress but not beyond the yielding stress is added to the outer side and the inner side of the pipe 1 with a stress caused by only the thermal treatment under the conditions described above without any internal pressurization.

Figure 14:
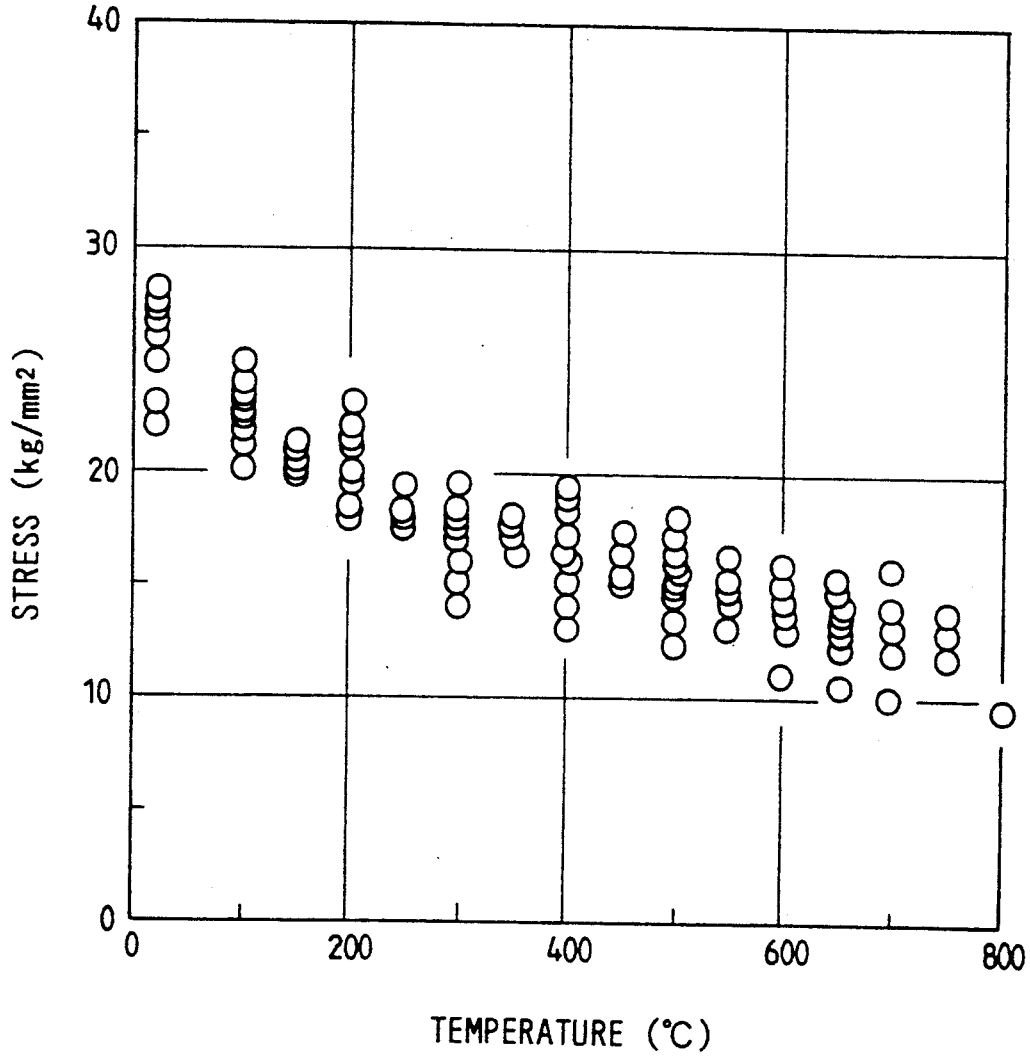
FIG. 14 is a graph showing the relationship between the temperature and stress of the pipe of the subject of the present invention.

Upon heating, addition of internal pressure to the pipe 1 causes a stress beyond the yielding stress in the inner side of the pipe 1, and a residual stress biased to the inner side of the pipe 1 remains after termination of heating and releasing of internal pressure Generally, a relationship between the yielding stress (2% yield point) of austenitic stainless steel., having a chemical composition as shown in Table 1, and temperature has a trend that the yielding stress decreases as the temperature rises as shown in FIG. 14, and the trend is significant in a range of 0°C.~250° C., but less in a range of 250° C.~500° C.

TABLE 1

| Symbol of Kind | | SUS316TP |
|---|---|---|
| Chemical composition (%) | C | Less than 0.08 |
| | Si | Less than 1.00 |
| | Mn | Less than 2.00 |
| | P | Less than 0.040 |
| | S | Less than 0.030 |
| | Ni | 10.00~14.00 |
| | Cr | 16.00~18.00 |
| | Mo | 2.00~3.00 |

In the present embodiment, as the temperature difference between the outer and the inner sides of the pipe 1 is provided in a range wherein the stresses generated by the temperature differential will not exceed the yielding stress, the temperature differential is provided in a relatively small range, and the range is restricted to a range of 250~500° C., wherein change of the yielding stress depending on the temperature change is small.

Therefore, it is not necessary to provide a large temperature differential to provide a residual stress by only a temperature differential between the outer and inner sides of the pipe 1, and also it is possible to avoid exceeding the yielding stress selectively in the outer side of the pipe depending on the different yielding stresses at the different temperatures in the outer and the inner sides of the pipe 1. Further, as the temperature differential of the outer and the inner sides of the pipe 1 can be small, the yielding stress $\sigma_{yi}$ at the temperature of the inner side of the pipe 1, $\sigma_{yo}$ at the temperature at the outer side of the pipe 1, and residual stresses in the outer and the inner sides of the pipes can be provided easily in a range near but not beyond the yielding stress, and an ideal stress region having stresses in a reversed direction in the outer and inner sides of the pipe with almost symmetrical distribution to the middle of the wall thickness of the pipe 1 is generated by the temperature differential.

As a hydraulic pressure provided by coolant to the inside of the pipe 1 (internal pressure) can be regulated precisely with a conventional technique by measuring the pressure with a pressure gauge installed at a plug 2 for the coolant, a resulting condition of a combined stress field of the stress field by the temperature differential and the stress by the internal pressure ca be precisely regulated.

A fact described above means that an arbitrary change of the residual stress of the pipe 1 can be regulated precisely with controlling the internal pressure of the pipe 1 arbitrarily by regulating the output power of the compressor 5.

Therefore, a residual stress provided to the pipe 1 can be regulated to be enough to offset an actual stress generated by an internal pressure of the pipe 1 in operation or use.

If a residual stress such as described above is attempted to be achieved only by a temperature differential between the outer and the inner sides of the pipe 1, stress distribution in the wall of the pipe 1 in the wall thickness direction has to be regulated with only temperature differential control, and it is impossible to provide such precise control or regulation with conventional techniques In the present embodiment, the temperature differential is regulated only in a range less than a range for causing the yielding stress, and energy necessary to cause yielding is provided by pressurization (internal pressure) with the coolant in the pipe 1.

The internal pressure in the present embodiment is 200 kg/cm$^2$. A stress caused by providing the internal pressure of 200 kg/cm$^2$ into the pipe 1 can be calculated with the equation (1) as $\sigma_t$=7.16kg/mm$^2$ in the inner side of the pipe 1 and $\sigma_t$=5.16 kg/mm$^2$ in the outer side of the pipe 1, and a superimposed stress of the stress by temperature differential and the stress by the internal pressure becomes $\sigma_{tmax}=\sigma_{y+}7.16$ (kg/mm$^2$) in the inner side and $\sigma_{tmin}=\sigma_{y+}5.16$ (kg/mm$^2$) in the outer side of the pipe 1, and as relations of $\sigma_{tmax}>\sigma_y$, $\sigma_{tmin}<\sigma_y$, and $\sigma_{tmin}>-\sigma_y$ are achieved, a stress distribution wherein the outer side of the pipe 1 will not cause yielding but only the inner side of the pipe 1 will cause yielding. In the case described above, $\sigma_y$ is early 15 kg/mm$^2$.

As a result of a measurement of residual stresses after treatments in accordance with the present invention is as shown in FIG. 1, and a field of biased residual stresses to the inner side of the pipe is obtainable so as to distribute a smooth stress curve without any peaking in a wall thickness direction.

Next, effects of the residual stresses given to the pipe 1 are described in connection with Table 2. Table 2 shows generated stresses in comparison of two cases, the one is a case wherein residual stresses by the present embodiment are provided in the pipe and the other one is a case wherein the residual stresses to the present embodiment are not provided in the pipe.

TABLE 2

| Embodiment of the present invention | Internal pressure (kg/cm$^2$) | Kind of stress | Maximum stress (inner side) (kg/mm$^2$) | Minimum stress (outer (side) (kg/mm$^2$) |
|---|---|---|---|---|
| No | 585 | Stress by internal pressure | 21.0 (= $\sigma_y$) | 15.1 |
| Yes | 725 | Stress by internal pressure | 26.0 | 18.7 |
| | | Residual stress | −5.0 | +2.0 |
| | | generated stress | 21.0 (= $\sigma_y$) | 20.7 |

y = 21.0 kg/mm$^2$

With no existing residual stress, the internal pressure of the pipe off 585 km/cm$^2$ generates 21 kg/mm$^2$ of stress, which is equal to the yielding stress, in the inner side of the pipe. At the moment, a stress generated in the outer side of the pipe in only 15.1 kg/mm$^2$, which is a value having a large margin to the yielding stress. But, the generated pressure in the inner side of the pipe is almost equal to the yielding stress, and, therefore, the maximum internal pressure which is provided to the pipe is 585 kg/cm$^2$.

On the other hand, in the case wherein a residual stress is provided to the pipe 1 by the embodiment of the present invention, even though an internal pressure of 725 kg/cm$^2$ is provided to the pipe 1 and a stress of 26.0 kg/mm$^2$ which is beyond the yielding stress is generated in the inner side of the pipe 1 by the internal pressure, a residual stress in the inner side of −5.0 kg/mm$^2$ offsets a part of the stress and a stress which is actually generated in the inner side of the pipe 1 lowers to 21.0 kg/mm$^2$ which is almost equal to the yielding stress. In the outer side of the pipe, even though a generated stress with the internal pressure is 18.7 kg/mm$^2$, a residual stress of 2.0 kg/mm$^2$ is superimposed and an increased stress of 20.7 kg/mm$^2$ is actually generated. But the increased stress is still less than the yielding stress and safety of the pipe is maintained.

As described above, the residual stress acts so as to correct biases in the stress distribution which is generated by the internal pressure in the circumferential direction of the pipe 1 and to make the stress distribution uniform, and, consequently, the maximum internal pressure allowable to the pipe 1 increases to 725 kg/cm$^2$.

That is, with the above-described embodiment of the present invention, the maximum allowable pressure of the pipe 1 is increased from 585 kg/cm$^2$ to 725 kg/cm$^2$, and an increment of about 24 % in pressure resistant strength is achieved.

The second embodiment of the present invention described hereinafter is different from the first embodiment only in an apparatus for adding residual stresses to the pipe 1 is provided.

Figure 15:
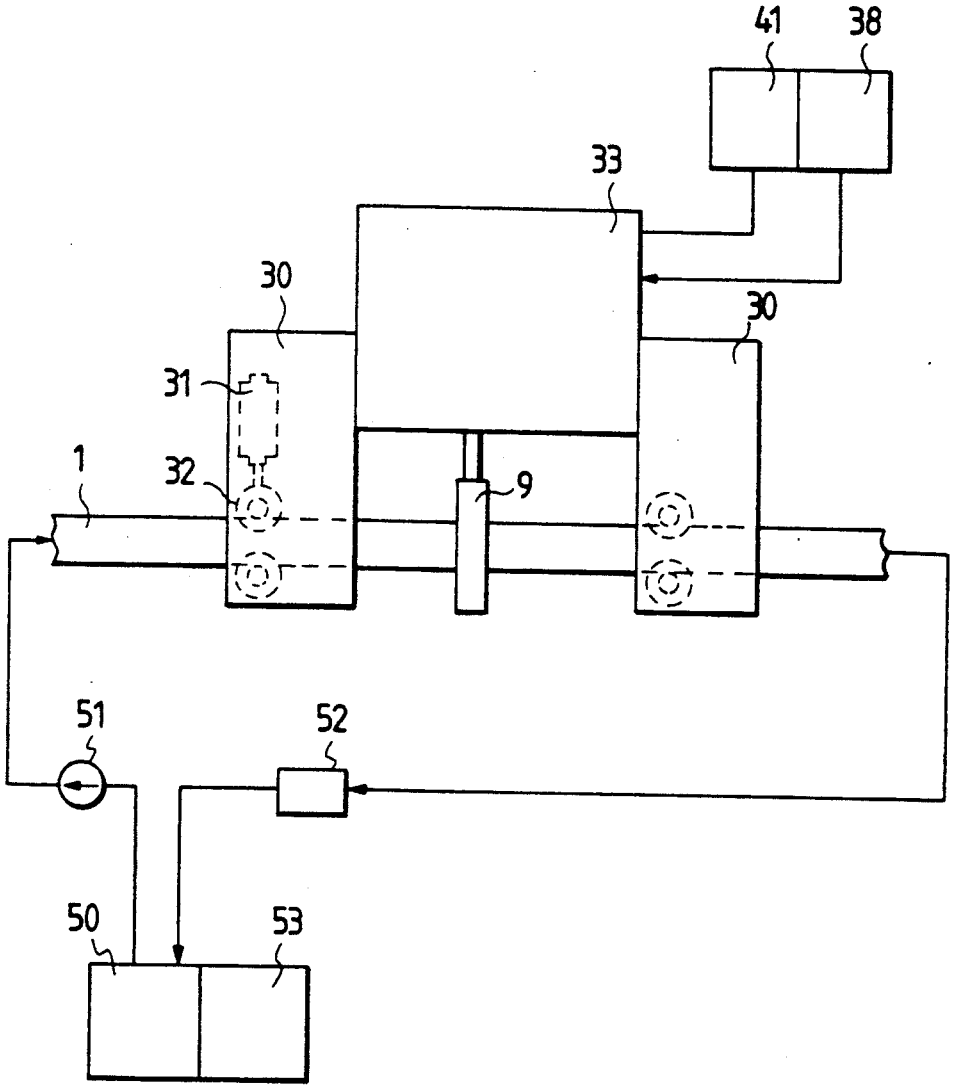
FIG. 15 is a schematic illustration of the apparatus for heat treatment and pressurizing treatment in accordance with a second embodiment of the present invention.
Figure 16:
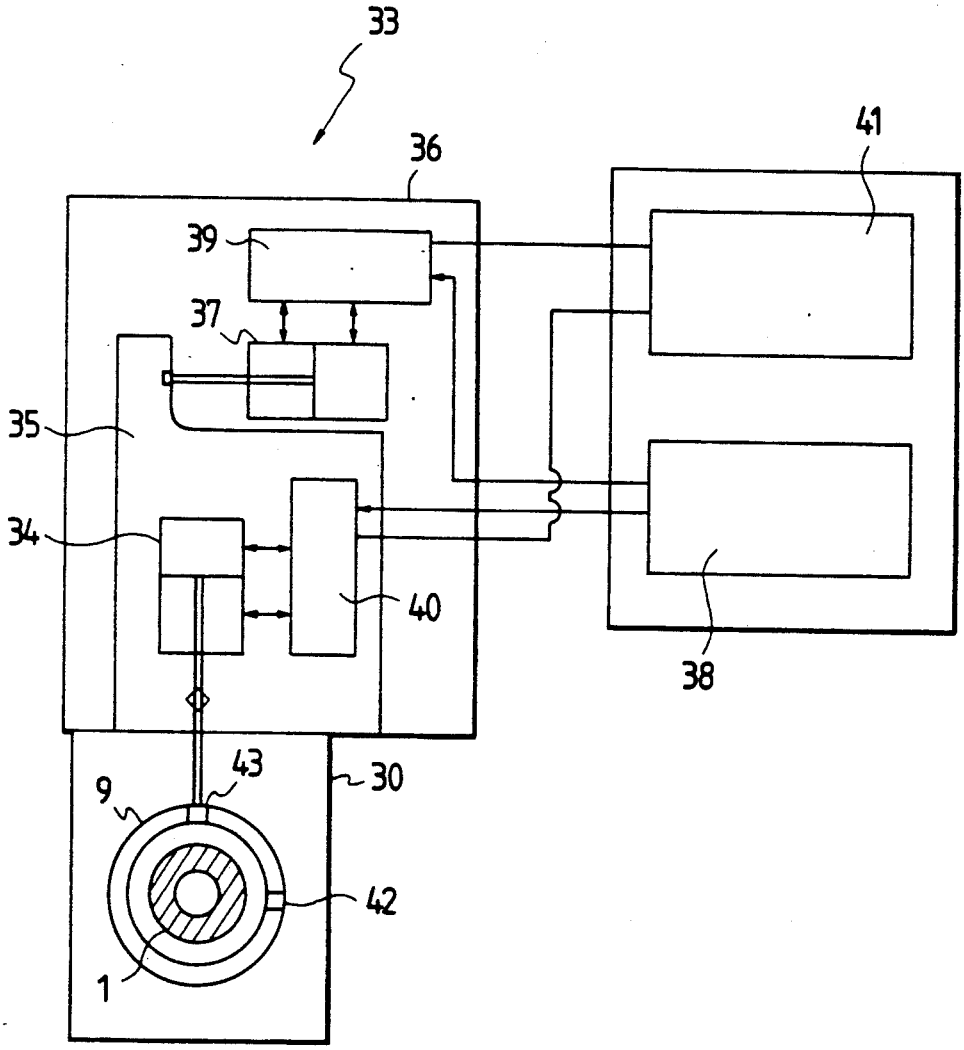
FIG. 16 is a detail illustration of the transferring device for the high frequency oscillation coil of FIG. 15.

In FIGS. 15 and 16, an apparatus 30 is provided for transferring a pipe 1 in an axial direction including a roller 32 rotated by an air pressure driven motor for catching the pipe 1 at the outer surface with other rollers and transfers the pipe 1 in the axial direction of the pipe 1.

Between each of the apparatus 30 for transferring of the pipe in the axial direction, a transferring apparatus for a high frequency oscillation coil 33 is provided for regulation of a position of the pipe of a high frequency oscillation coil 9 which is arranged around the pipe 1 as shown in FIG. 16. The high frequency oscillation coil 16 is connected and supported by a piston rod of an air cylinder 34 installed on a slider 35 set on a base plate 36 in a manner so as to allow free sliding movement Another air cylinder 37 is installed on the base plate 36 in a position at a right angle to the air cylinder 34. A piston rod of the air cylinder 37 is connected to the slider 35 Servo valves 39, 40 regulating feeding and exhausting of air pressure from air supply 38 to the cylinders are respectively connected to the air cylinders 34, 37. Each of the servo valves 39, 40 is able to selectively operate extension and shrinking of the air cylinders 34, 37 with signals from a signal controlling apparatus 41 in a control panel. Signals from the signal controlling apparatus 41 are delivered in dependance upon signals received from ultrasonic distance sensors 42, 43 installed inside the high frequency oscillation coil 9 separated at a right angle with respect to each other and directed toward the outer surface of the pipe 1. The ultrasonic distance sensors 42, 43 deliver signals indicating a distance of the ultrasonic distance sensors 42, 43 relative to the pipe 1 for enabling a determination of the actual position as compared with a desired setting distance from the outer surface of the pipe 1. The setting distance means a distance set in a range which is determined with a gap having such a small range as allowable errors between the high frequency oscillation coil 9 and the outer surface of the pipe 1 in a condition wherein a center axis of the pipe 1 coincides with a center axis of the high frequency oscillation coil 9. The signal controlling apparatus 41 generates signals to the servo valves 39, 40 indicating which of the air cylinders 34, 37 is operable depending on the distance signals from the ultrasonic distance sensors.

When the ultrasonic distance sensor 42 delivers a distance signal indicating the distance sensor 42 is too near the pipe 1 as compared with the desired setting, the signal controlling apparatus 41 receives the signal and delivers a signal to the servo valve 39 to shrink the air cylinder 37. When the ultrasonic distance sensor 42 delivers a signal indicating the ultrasonic distance sensor 42 is too far from the pipe 1 , the signal controlling apparatus 41 receives the signal and delivers a signal to the servo valve 39 to extend the air cylinder 37 In this manner, air pressure from the air supply 38 is fed to or exhausted from the air cylinder 37 and moves the slider 35 horizontally with the signal from the ultrasonic distance sensor 42, and a horizontal gap between the high frequency oscillation coil 9 and the outer surface of the pipe 1 is adjusted in a range of a desired setting distance.

When the ultrasonic distance sensor 43 delivers a signal indicating the ultrasonic distance sensor 43 is too near the pipe 1 as compared with the desired setting, the signal controlling apparatus 41 receives the signal and delivers a signal to the servo valve 40 to shrink the air cylinder 34 when the ultrasonic distance sensor 34 delivers a signal indicating the ultrasonic distance sensor 43 is too far from the pipe 1, the signal controlling apparatus receives the signal and delivers a signal to the servo valve 40 to extend the air cylinder 34. In this manner, air pressure from the air supply 38 is fed to or exhausted from the air cylinder 34 and moves the coil 9 vertically with the signal from the ultrasonic distance sensor 43, and a vertical gap between the high frequency oscillation coil 9 and the outer surface of the pipe 1 is adjusted in a range of a desired setting distance.

When both of the ultrasonic distance sensors 42, 43 deliver the signals concurrently, both of the air cylinders 34, 37 operate concurrently to maintain the center of the high frequency oscillation coil 9 coincidental with the center axis of the pipe 1. The signal controlling apparatus 41 has a judging circuit so as to enable the above-described signal selection.

The high frequency oscillation coil 9 is connected to a high frequency oscillator which functions to heat the pipe with induction heating when high frequency current is supplied.

A coolant storage tank 50, storing high pressure cooling water which is pressurized with a compressor 53, is connected to an end of the pipe 1 through a pump 51 with high pressure tubes, and another end of the pipe 1 is connected to the coolant storage tank 50 through a cooler 52 with high pressure tubes. Therefore, when the pump 51 is operated, cooling water in the coolant storage tank 50 flows into the pipe 1 through the one end of the pipe 1 and flows out of the other end of the pipe 1, and is thereafter cooled by the cooler 52, and flows back into the coolant storage tank 50 thereby providing a coolant circulation.

In the apparatus described above, with a continuous flow of cooling water cooled by the cooler 52 through the pipe 1 by operation of the pump 51, the pipe 1 is heated inductively by supplying high frequency current to the high frequency oscillation coil 9. Heating temperature of the pipe 1, internal pressure provided to the pipe 1 by the cooling water, temperature of the cooling water, and circulation flow rate of the cooling water are the same as the first embodiment.

Under the condition described above, a roller 32 is rotated continuously by an air-driven motor 31 and transfers the pipe 1 in an axial direction. The moving speed of the pipe 1 is set as the same as the moving speed of the high frequency oscillation coil 9 in the first embodiment. After the heating and pressurization treatments are performed in the manner described above, the internal pressure of the pipe 1 is released by stopping the operation of the pump 51 and the compressor 53.

With the method described above, an improvement of the pressure resistance property of the pipe 1 is realized by providing a residual stress the same as the first embodiment to the pipe 1 through the treatment of heating and pressurization of the pipe 1 with the same conditions as the first embodiment being achieved.

The pipe 1 comprises not only a straight pipe but also a curved pipe along a piping route in a plant. In a case wherein an embodiment of the present invention is applied to a curved pipe, deviations in the size of the gaps between the high frequency oscillation coil 9 and the outer surface of the pipe 1 might occur while the curved pipe is being transferred in an axial direction by the transfer apparatus 30. When such deviation occurs, the ultrasonic distance sensors 42, 43 detect the amount of the deviations and deliver signals to the signal controlling apparatus 41, and, consequently, the deviations in gap width can be adjusted by the movement of the air cylinders 34, 39. Therefore, uneven heating of the pipe will be avoided and improvement of the curved pipe in a pressure resistance property automatically achieved.

What is claimed is:

1. A method for strengthening a pressure resistance property of a hollowed structure made of a metallic material, the method comprising the steps of:

providing a temperature differential in said metallic material in a thickness direction between an outer side and an inner side of said metallic material within a range sufficient to generate a stress not exceeding a yielding stress of said metallic material, pressurizing one of the outer side and the inner side of said metallic material to an extent so as to superimpose a stress generated by the pressurizing and the stress caused by the temperature differential reaching the yielding stress of the metallic material, and releasing the pressure provided in the step of pressurizing subsequent to the superimposed stress reaching a level of the yielding stress of the metallic material.

2. A method for strengthening a pressure resistance property of a hollowed structure made of a metallic material, the method comprising the steps of:

providing a stress field with stress thereof having mutually opposite directions at an outer side and an inner side of said metallic material within a range of stresses not exceeding a yielding stress of the metallic material, providing an external stress to one of the outer side and the inner side of said metallic material such that a stress of the stress field has the same direction with the external stress to an extent such that a stress superimposed with the stress in the stress field reaches the yielding stress of said metallic material, and releasing the external stress subsequent to the superimposed stress reaching a level of the yielding stress of said metallic material.

3. A method for strengthening a pressure resistance property of a hollowed structure made of a metallic material, the method comprising the steps of:

providing a stress to said metallic material by heating a first side and cooling an opposite side of the metallic material within a range of stresses not exceeding a yielding stress of the metallic material, providing an external stress to one of the first side and opposite side of the metallic material in the same direction as the stress provided in said first side of the metallic material by heating and cooling to an extent that a superimposed stress reaches a level of the yielding stress of the metallic material, and releasing the external stress subsequent to the the superimposed stress reaching the level of the yielding stress of the metallic material.

4. A method for strengthening a pressure resistance property of a hollowed structure made of a metallic material, the method comprising the steps of:

providing a stress to said metallic material by heating of an outer side and cooling of an inner side of said hollowed structure within a range of stresses not exceeding a yielding stress of said metallic material, providing a stress to the inner side of the hollowed structure by introducing an internal pressure into the hollowed space of said hollowed structure to an extent such that a superimposed stress reaches a level exceeding the yielding stress of the metallic material, and subsequently releasing the introduced internal pressure from said hollowed structure.

5. A method for strengthening a pressure resistance property of a hollowed structure made of metallic material, the method comprising the steps of:

flowing a pressurized coolant into a hollow space of the hollowed structure so as to provide a stress in the hollowed structure less than a yielding stress of the metallic material, and providing a quantity of heat to said hollowed structure so as to create a stress exceeding the yielding stress of the metallic material in an inner side of the hollowed structure and to crate a stress of less than the yielding stress of the metallic material in an outer side of the hollowed structure by moving a heating means along a circumferential surface of said hollowed surface during a flowing of the pressurized coolant.

6. A pressure resistant hollowed structure made of metallic material and being adapted to withstand an internal pressure, the hollowed structure comprising:

a compressive residual stress in an inner side of the hollowed structure, said compressive residual stress having a larger absolute value than a tensile stress caused in the inner side of the hollowed structure by the internal pressure, and a tensile residual stress in an outer side of said hollowed structure having a value of less than a tensile yielding stress of the metallic material of said hollowed structure even though a tensile stress is superimposed in the outer side of the hollowed structure by the internal pressure.

7. A method of pressure resistant usage of a pressure resistant hollowed structure made of a metallic material, with the hollowed structure being adapted to absorb a stress caused by an internal pressure to the hollowed structure the method comprising the steps of:

providing a compressive residual stress in an inner side of said hollowed structure, said compressive residual stress having a larger absolute value than a tensile stress caused by the internal pressure acting on the inner side of the hollowed structure, providing a tensile residual stress in an outer side of said hollowed structure having a value of less than a tensile yielding stress of the metallic material of said hollowed structure even though a tensile stress caused by the internal pressure is superimposed in the outer side of the hollowed structure, offsetting the tensile stress caused by the internal pressure in the inner side of the hollowed structure with the compressive residual stress in the inner side of the hollowed structure to within a range of less than a tensile yielding stress of the metallic material, and superimposing the tensile stress caused by the internal pressure in he outer side of the hollowed structure on the tensile residual stress in the outer side of said hollowed structure to within a range of less than the tensile yielding stress of the metallic material of said hollowed structure.

* * * * *